United States Patent [19]

Herrington

[11] Patent Number: 4,532,652

[45] Date of Patent: Jul. 30, 1985

[54] PLASTIC BAG WITH AIR EXHAUSTION VALVE

[75] Inventor: F. John Herrington, Holcomb, N.Y.

[73] Assignee: Mobil Oil Corporation, New York, N.Y.

[21] Appl. No.: 552,520

[22] Filed: Nov. 16, 1983

[51] Int. Cl.[3] ..... B65D 27/20

[52] U.S. Cl. ..... 383/103; 383/63

[58] Field of Search ..... 383/103, 63

[56] References Cited

U.S. PATENT DOCUMENTS 3,302,859 2/1967 Perry ..... 383/103

*Primary Examiner*—John E. Kittle
*Assistant Examiner*—James J. Seidleck
*Attorney, Agent, or Firm*—Alexander J. McKillop; Michael G. Gilman; Charles J. Speciale

[57] ABSTRACT

An air-exhausting flexible plastic bag is provided which comprises a flexible film defining the bag, a closure means for air-tightly closing the bag, and a one-way air valve for exhausting air from the bag when closed. The valve uses the flexible film of the bag as a flapper, which seats against a backing member adhered to an inner surface of the flexible film except at regions of the film surrounding venting holes therein.

4 Claims, 5 Drawing Figures

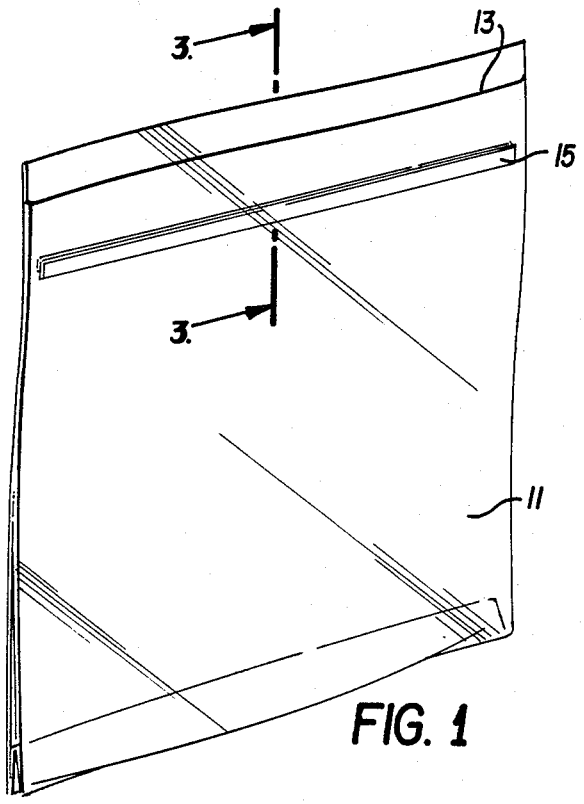
FIG. 1
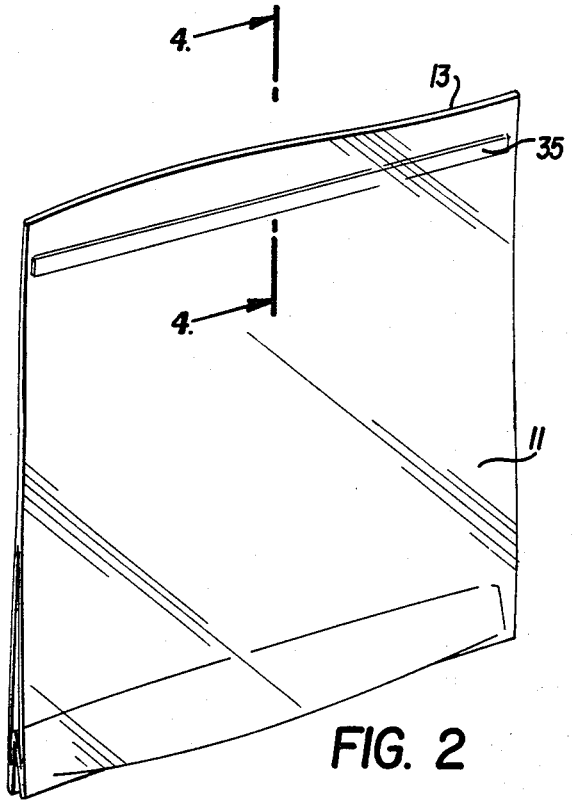
FIG. 2
FIG. 3
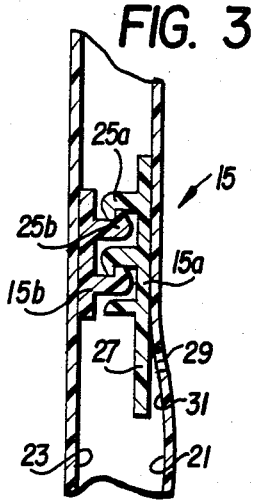
FIG. 4
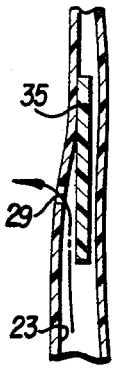
FIG. 5
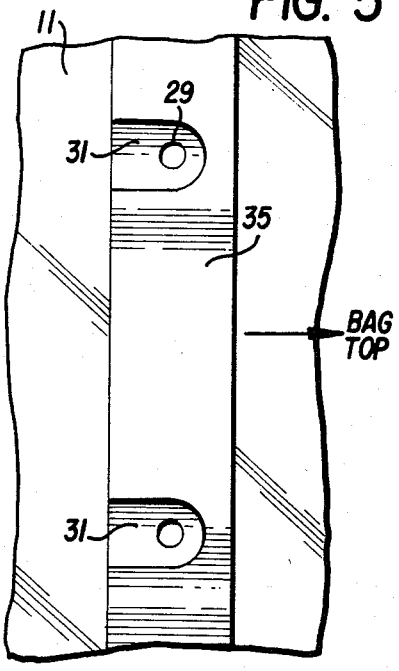

PLASTIC BAG WITH AIR EXHAUSTION VALVE

BACKGROUND OF THE INVENTION

1. Field of the Invention

The present invention relates to closable air-tight plastic bags which have a one-way air valve for exhausting air after the bag is closed. It particularly, though not exclusively, relates to resealable air-tight food storage-type bags having a one-way air exhausting valve.

2. Discussion of the Prior Art

Closable plastic bags, particularly those known as food storage bags, are widely used to preserve food. Such bags usually have a closure member for securely and, in many instances, air-tightly closing the bag. One example of an air-tight closure is that used in the Zip-loc storage bag, which is illustrated in U.S. Reissue Pat. No. 28,969. Another type of sandwich bag having an air-tight closure is illustrated in co-pending U.S. Patent Application Ser. No. 433,588 filed Oct. 12, 1982.

While air-tight closures are preferred to maintain food freshness, it is difficult to exhaust air from the bags upon closure. At present, a user must coordinate his movements so that the food-filled bag is first substantially, but not completely, closed, then air-exhausted by pressing the air from the bag and then completely closed before a substantial amount of air re-enters the bag. The movements required are cumbersome and are not easily performed by those lacking a high degree of dexterity and coordination. Accordingly, the bag is often not air-exhausted to the extent it could be or is not air-exhausted at all, which decreases the ability of the sealed bag to maintain food freshness.

When larger high strength bags are used in industrial applications, entrapped air in a filled bag distorts the bag shape, making transportation and storage of filled bags difficult. Entrapped air may also affect the bag contents.

SUMMARY OF THE INVENTION

One object of the present invention is the provision of a unique bag construction which can be air-tightly sealed and, after sealing, air-exhausted to reduce the amount of air contained in the sealed bag. This objective is achieved by providing a one-way air valve in the sealable bag which can exhaust air from the bag interior, but which prevents the ingress of air into the sealed bag from the exterior. Accordingly, after sealing, simple pressure applied to the bag can be used to exhaust air therefrom.

An additional object of the invention is the provision of a bag construction as described in the preceding paragraph, in which the air-valve is of a simple, inexpensive and readily manufactured construction.

These objectives are attained by providing a bag having a resealable closure with a relatively stiff strip of plastic inside the bag which is adhered to the bag except in overlying regions of the bag which surround holes in the bag film. Normally, pressure outside the bag will cause the film to push against the strip, sealing the hole and preventing the ingress of air into the bag. Pressure inside the bag, created, for example, by squeezing the sealed bag, will cause the film to lift away from the relatively stiff strip, exposing the hole and permitting the escape of air from the bag interior.

The above described objects, features and advantages of the invention will be more clearly understood from the following detailed description of the invention, which is provided in connection with the accompanying drawings.

BRIEF DESCRIPTION OF THE DRAWINGS

FIG. 1 illustrates a reclosable air-tight bag employing a first embodiment of the invention;

FIG. 2 illustrates a reclosable air-tight bag employing a second embodiment of the invention;

FIG. 3 is a sectional view along the lines 3—3 in FIG. 1;

FIG. 4 is a sectional view along the lines 4—4 in FIG. 2; and

FIG. 5 is a plan view of a portion of the bag illustrated in FIG. 2.

DETAILED DESCRIPTION OF THE INVENTION

A first embodiment of the invention is shown in FIGS. 1 and 3. A closable air-tight bag 11 is formed of a flexible plastic film, such as polyethylene. An opening 13 provided in the top of the bag is closable by means of an interlocking seal 15, shown in greater detail in FIG. 3. The seal 15 includes two engaging portions 15*a*, 15*b*, which are respectively bonded, e.g., by heat or adhesive, to opposing inner surfaces 21,23 of the flexible film forming the bag. The two engaging portions 15*a*, 15*b* oppose one another and respectively contain hook-like locking protrusions 25*a*, 25*b* which are interengageable to form a reclosable air-tight seal for closing the opening 13 of bag 11. One of the engaging portions, e.g., 15*a*, has an extending portion 27 which acts as a backing member of a one-way valve. At least one hole 29 is provided in the flexible film at areas thereof which overlie the backing member. The backing member 27 is adhered to the inner surface of the flexible film throughout its extent, except in overlying regions 31 of the film which surround the hole(s) 29 so that the plastic film in these overlying regions acts as a valve flapper. As a consequence, when opening 13 of bag 11 is closed by pressing the engaging portions 15*a*, 15*b* into interlocking engagement, air can be exhausted from the bag by outside pressure applied thereto. This exhausting air causes the flexible film, which is normally pressed flat against the backing member, to move away from the backing member, as shown in FIG. 3, by virtue of the non-adhered areas of the film, permitting exhaustion of air from the bag interior.

The backing member is made of a material having a greater stiffness than the flexible plastic material forming the bag. For example, a stiff piece of polyethylene can be used. In the first embodiment of the invention described above, the backing member is integrally formed as part of one of the engaging portions of the interlocking closure seal 15. However, as shown in FIGS. 2, 4 and 5, the backing member can be separately formed as a backing strip 35, which is bonded to an inner surface 23 of the bag flexible film near the top of the bag, except at overlying regions 31 of the film which suround the hole(s) 29. This type of adherence, which is shown in FIG. 5, is also that which can be used in the embodiment of FIGS. 1 and 3. In the second embodiment, an air-tight closure of the bag can be performed by heat sealing. Once sealed, the bag can then be air exhausted in the manner described above and as illustrated in FIG. 4.

One or more holes 29 can be provided in the flexible plastic film along the backing member, two being representatively illustrated in FIG. 5.

As is evident from the discussion above, a one-way air exhaustion valve is provided for a reclosable air-tight plastic bag, which permits exhaustion of air from the bag interior while preventing entry of air into the bag from the exterior. The valve construction is economical and easily produced during bag manufacture.

Although two preferred embodiments of the invention have been described and illustrated, it should be readily apparent that many modifications can be made to the invention without departing from its spirit or scope. For example, although food storage bags have been described and illustrated, the invention can also be used with other sizes and types of bags. Accordingly, the invention is not to be construed as being limited by the foregoing description, but is only limited by the scope of the appended claims.

I claim:

1. A flexible bag having a closure comprising:

a flexible plastic film defining said bag;

a means for closing and air-tightly sealing said bag and comprising a pair of cooperating reclosable engaging members respectively provided on opposing inner surfaces of said film and extending along a closable opening in said bag; and a one-way air valve for exhausting air from said bag when sealed, said air valve comprising at least one backing member formed by an extending integral portion of one of said engaging members and adhered to an inner surface of said film, and at least one venting hole provided in said film and overlying said at least one backing member, said at least one backing member being adhered to said film except at overlying regions of said film surrounding said at least one venting hole.

2. A bag as in claim 1, wherein said at least one backing member is a strip member which is stiffer than said flexible film.

3. A bag as in claim 2, wherein said at least one backing member is formed of a plastic material.

4. A bag as in claim 2, further comprising a plurality of venting holes in said film overlying said at least one backing member, said at least one backing member being adhered to said film except at overlying regions of said film surrounding said venting holes.

* * * * *